US008370996B2

(12) United States Patent
Gaitan et al.

(10) Patent No.: US 8,370,996 B2
(45) Date of Patent: Feb. 12, 2013

(54) ACOUSTICAL TREATMENT OF POLYMERIC FIBERS AND SMALL PARTICLES AND APPARATUS THEREFOR

(75) Inventors: Dario Felipe Gaitan, Nevada City, CA (US); Robert Hiller, Grass Valley, CA (US); Lawrence A. Crum, Bellevue, WA (US)

(73) Assignee: Impulse Devices Inc., Grass Valley, CA (US)

( * ) Notice: Subject to any disclaimer, the term of this patent is extended or adjusted under 35 U.S.C. 154(b) by 183 days.

(21) Appl. No.: 12/797,362

(22) Filed: Jun. 9, 2010

(65) Prior Publication Data

US 2011/0016671 A1 Jan. 27, 2011

Related U.S. Application Data

(60) Provisional application No. 61/185,404, filed on Jun. 9, 2009.

(51) Int. Cl.
*D01G 99/00* (2010.01)

(52) U.S. Cl. ..... 19/66 R

(58) Field of Classification Search ..... 19/66 R; 376/100, 149; 422/128
See application file for complete search history.

(56) References Cited

U.S. PATENT DOCUMENTS

| | | | | |
|---|---|---|---|---|
| 4,333,796 | A * | 6/1982 | Flynn | 376/100 |
| 5,658,534 | A * | 8/1997 | Desborough et al. | 422/128 |
| 6,627,784 | B2 * | 9/2003 | Hudson et al. | 588/320 |
| 7,448,790 | B2 * | 11/2008 | Tessien et al. | 366/114 |
| 7,687,039 | B2 * | 3/2010 | Laugharn et al. | 422/128 |
| 2005/0135532 | A1 * | 6/2005 | Taleyarkhan et al. | 376/100 |
| 2006/0034705 | A1 * | 2/2006 | Tessien et al. | 417/321 |

* cited by examiner

*Primary Examiner* — Shaun R Hurley
(74) *Attorney, Agent, or Firm* — Ibrahim M. Hallaj; Intrinsic Law Corp

(57) ABSTRACT

Systems and methods for treating small elongated fibrous and particles of certain materials, e.g., PTFE materials in a suspension are presented. In some instances, high-intensity ultrasound (or acoustical energy) is applied to a sample of the material, through a fluid coupling medium or suspension, to achieve a material transformation in the sample. In various embodiments, fibrillation of particles of PTFE or similar materials is accomplished, or the formation of extended structures of these materials is caused or enhanced. Also, the ability to separate long fiber samples by ultrasonic or acoustic cavitation action is provided.

32 Claims, 4 Drawing Sheets

ACOUSTICAL TREATMENT OF POLYMERIC FIBERS AND SMALL PARTICLES AND APPARATUS THEREFOR

RELATED APPLICATIONS

This application is related to and claims the benefit under 35 U.S.C. §119 of provisional application 61/185,404, entitled "Acoustical Treatment of Certain Fibers and Small Particles and Apparatus Therefor," filed on Jun. 9, 2009, which is hereby incorporated by reference.

TECHNICAL FIELD

The present application relates to treatment or pre-treatment of fibrous and other small elongated and particulate materials using an acoustical field.

BACKGROUND

Fibers and thin elongated materials can be of many uses in industrial and other applications. Fibrous materials can be created in bulk by weaving or mechanically or chemically bonding or coupling small fibrous material elements into a larger structure. Examples are in the manufacturing of rope, cloth fabric, composites, and other materials. Also, small particles may be used, alone or in combination with fibrous materials to form useful structures. The use of fibers, including those made of polytetrafluoroethylene (PTFE), has numerous uses in various industrial, manufacturing, and other fields. Also, the use of small (sometimes "micro," or "nano")-sized particulate materials has been found useful in various applications.

In some instances, the creation of the above useful structures requires processing or pre-processing (generally referred to as processing) of the components of the structures before or during their manufacture. Chemical processing, thermal, mechanical, or other processing steps may be used to enhance or enable the formation of the desired structures. In addition, some types of processing are required or useful to give the final products a desired property.

A brief discussion of a modality of treating materials is presented now, which is the application of acoustic cavitation in a fluid environment. It is known that acoustic fields can be applied to fluids (e.g., liquids, gases) within resonator vessels or chambers. For example, standing waves of an acoustic field can be generated and set up within a resonator containing a fluid medium. The acoustic fields can be described by three-dimensional scalar fields conforming to the driving conditions causing the fields, the geometry of the resonator, the physical nature of the fluid supporting the acoustic pressure oscillations of the field, and other factors.

One common way to achieve an acoustic field within a resonator is to attach acoustic drivers to an external surface of the resonator. The acoustic drivers are typically electrically-driven using acoustic drivers that convert some of the electrical energy provided to the drivers into acoustic energy. The energy conversion employs the transduction properties of the transducer devices in the acoustic drivers. For example, piezo-electric transducers (PZT) having material properties causing a mechanical change in the PZT corresponding to an applied voltage are often used as a building block of electrically-driven acoustic driver devices. Sensors such as hydrophones can be used to measure the acoustic pressure within a liquid, and theoretical and numerical (computer) models can be used to measure or predict the shape and nature of the acoustic field within a resonator chamber.

If the driving energy used to create the acoustic field within the resonator is of sufficient amplitude, and if other fluid and physical conditions permit, cavitation may take place at one or more locations within a liquid contained in an acoustic resonator. During cavitation, vapor bubbles, cavities, or other voids are created at certain locations at times within the liquid where the conditions (e.g., pressure) at said certain locations and times allow for cavitation to take place.

Under certain conditions, the acoustic action of a transducer and the resonance chamber may set up an acoustic field within the fluid in the chamber that is of sufficient strength and configuration to cause acoustic cavitation within a region of the resonance chamber. Specifically, under suitable conditions, acoustic cavitation of the fluid in the chamber may cause bubbles or acoustically-generated voids, as described above and known to those skilled in the art, to form within one or more regions of the chamber. The cavitation usually occurs at zones within the chamber that are subjected to the most intense (highest amplitude) acoustic fields therein.

Other ways have been known to cause acoustic cavitation in liquids and similar materials. For example, a high-intensity acoustic horn comprising a special metallic horn-shaped tool at one end that is driven by an electrical driver can be used to impart sufficient acoustic energy into a fluid so as to cause cavitation voids in a region of the fluid.

The detailed description below provides numerous embodiments and benefits of applying acoustical energy and cavitation to a suitable material in order to process and transform the same.

SUMMARY

The industrial production of specialty fibers represents a substantial business in the U.S. and worldwide. Production lines often start with the raw materials and end with a spool of fiber ready for use in a variety of fabrics and textiles. Because of this unbroken fiber production process, a limited number of modifications to the fiber constituents themselves can be accomplished. Significant improvements in fiber strength, surface characteristics, and filament packing are desirable but difficult to implement. One application of such fibers is in the self-lubricated bearing market (to name but an example) which are used in sophisticated highly machined metal backed and composite plain, rod end, and thrust bearings, as will be described further below.

Aspects of the present application describe ways to process thin fibers and small particles of certain types to achieve or enhance desired results and properties of these materials or the articles of manufacture resulting therefrom. The present disclosure generally relates to methods and systems for treating certain fibrous and/or particulate materials with ultrasound. More specifically, the present disclosure provides methods and apparatus for treating such fibers and other small particles to relatively high-intensity acoustic energy, including ultrasonic acoustic energy, which can in some instances cause cavitation activity proximal to said fibers and small particles to transform these in a useful way.

In embodiments hereof, useful material and/or surface modifications to PTFE fibers and other small structures and particles are achieved by the application of high-intensity ultrasound (HIU) applied to the materials. This can include in a non-contact form to fiber filaments, and can include through applying a cavitation field delivered for example through a fluid medium in contact therewith. If the appropriate surface modifications can be achieved, formation of more stable resin systems would provide for greater adhesion with a substrate, thus improving self lubricated bearing systems. The prospect of achieving a continuous filament altered in this way broadens the range of potential applications to fabric bearing systems, would enable custom milling to specified dimensions, and may also advance other technologies not yet recognized. Modifying fibers in this way will also impact filtration applications, another important market component. The increased available surface area, resulting torturous pathways across a lighter more efficient filter media, and the creation of microfibrils holds great potential for the filtration industry.

BRIEF DESCRIPTION OF THE DRAWINGS

For a fuller understanding of the nature and advantages of the present concepts, reference is be made to the following detailed description of preferred embodiments and in connection with the accompanying drawings, in which.

DETAILED DESCRIPTION

Figure 1:
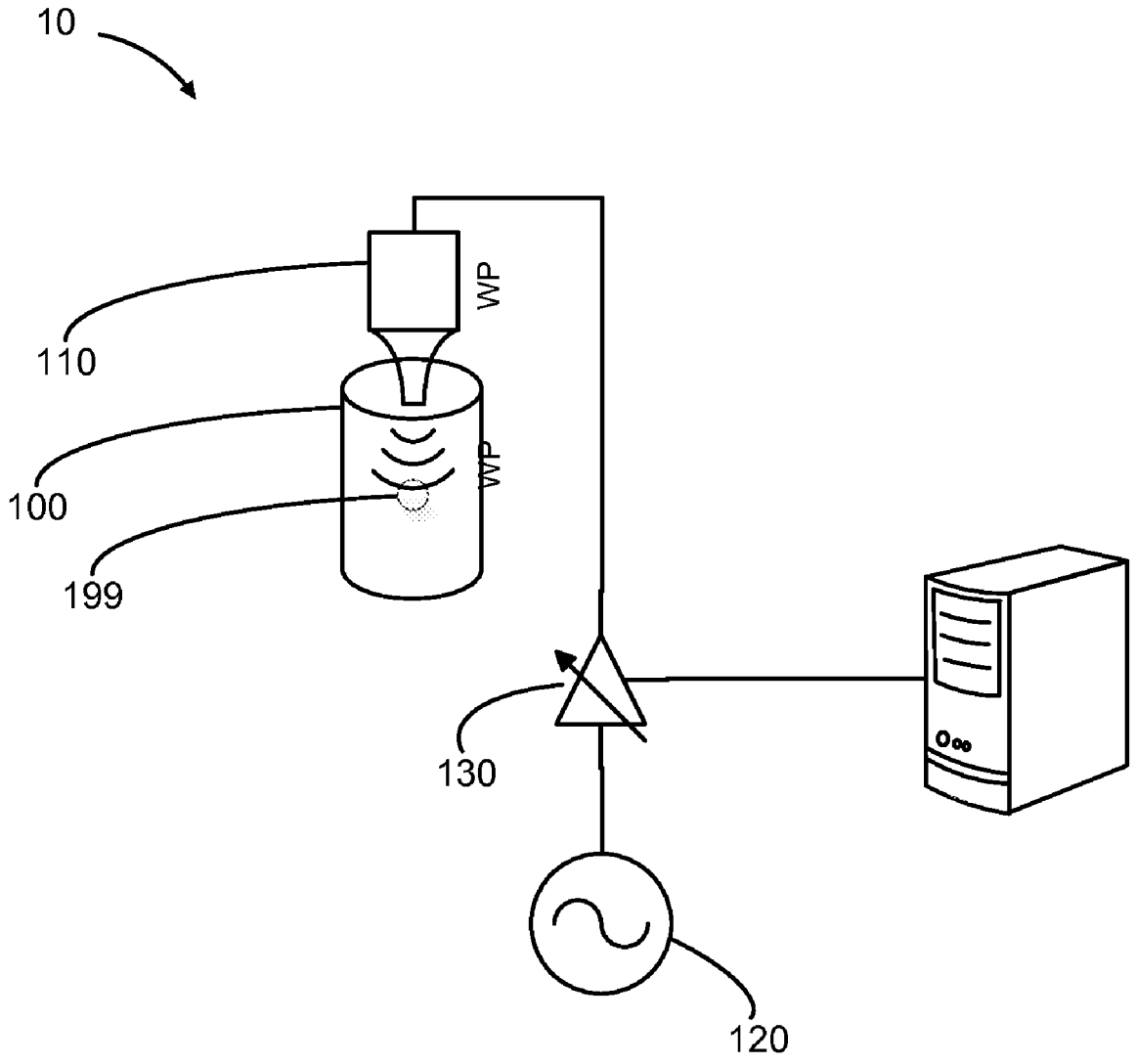
FIG. 1 illustrates an acoustic resonator system for processing a polymeric substance.

Polymers and polymeric materials have found wide and pervasive use in almost every field of industry and manufacturing. These materials can be formed into many useful configurations including small particulates and elongated fibers. Polytetrafluoroethylene (PTFE) fibers, and those sometimes referred to by their commercial names, e.g., DuPont's Teflon®, Gore-Tex® from W.L. Gore & Associates, have been shown to be useful for use in a variety of applications. For example, PTFE may be used in the manufacture of bearings. These fibers and similar materials are appropriate for use in certain processes because they are easy to process in standard textile steps into useful forms.

Many thin fabrics and high polymer orientation-PTFE materials have low friction coefficients. When used in mechanical applications, their load capacity is related to their thickness and polymer orientation. PTFE fibers allow the production of thin structures of highly uniaxially-oriented polymers with orientations that are favorable to those of other thin films and fibers.

Other steps for processing PTFE material take advantage of the ability to combine these materials with other fibers to control the wetting properties of the product. In this way a resin substance can be wicked into the fiber or fabric material, for example, providing a good bond and improved abrasion and load capacity to the resulting structures. The wicking action is partially due to surface and capillary effects and other fluid forces acting on and around the surfaces of the material.

Certain types of fibers and small particles can benefit from treatment by acoustic energy, including relatively high-intensity ultrasonic energy. High intensity ultrasound (HIU) can be provided to these materials using an acoustic source transmitting acoustic energy through an acoustic coupling medium such as a fluid medium. A variety of transducers have been developed that are useful in applying acoustic energy to a medium that contains the fibers and small particles of interest. The transducers convert electrical energy into mechanical energy in the form of intense high frequency sound waves. For the present purposes, and by way of non-limiting illustration, we consider a frequency range from about 20 kHz to about 2 MHz, or in the low tens of kHz frequency range. In this frequency range the absorption of ultrasound is relatively low in most liquids and solids. Accordingly, one physical mechanism whereby HIU can effect changes is through the phenomenon of acoustic cavitation. Another is through acoustic streaming, which causes a local flow pattern in a fluid near the acoustic source.

Two categories of acoustic cavitation can be considered relevant in this context. A first type of cavitation may be termed "stable cavitation," in which the time-varying acoustic pressure amplitude of the acoustic waves results in violent oscillations of a gas bubble or a group of bubbles clustered about a region of space experiencing the appropriate conditions to cause cavitation. These high amplitude oscillations can induce high shear stresses associated with the movement of the liquid in the vicinity of the oscillating bubble(s). A second type of cavitation may be termed "inertial cavitation," in which the acoustic pressure fluctuations are so strong that the liquid itself is ruptured and a (mostly) vapor-filled cavity is formed. When this vapor-filled cavity is collapsed during the positive pressure cycle, violent mechanical forces are produced in the form of high speed liquid jets and intense shock waves. The flowing, streaming, jetting, and other action in the fluid can lead to mechanical and other effects of the cavitation field and bubbles on fibers and particles subjected thereto. In general, stable cavitation produces a substantially continuing perturbation of lower relative amplitudes, while inertial cavitation produces isolated perturbations of higher relative amplitudes. With this in mind, we turn to the transformative effects of HIU of the present fibers and particulate materials.

As mentioned earlier, PTFE and homopolymer multifilament fibers are of particular interest in some embodiments. At its initial stage of production, individual filaments (filament diameters immediately out of the spinneret are typically ~140 microns with a finished diameter of 15 to 20 microns) are produced, each of which may be a dispersion of PTFE nanospheres (~150 nm) in a cellulose matrix. It should be appreciated that the parameters and dimensions given herein are exemplary, and those skilled in the art would understand that the present disclosure and scope applies to a wide variety of such parameters and dimensions. Upon these an appropriate ultrasonic field, having some energy level and frequency content, is operated.

In some embodiments, a variety of engineering production steps may be undertaken to process the fibrous and/or small particulate materials. For example, the filaments are heated to fuse the PTFE nanospheres into a monofilament (called sintering) with significant tensile strength and desirable qualities. Some cellulose may burn off during this process. The resulting fiber may have some or all of the following characteristics: (a) It is a multifilament textile yarn; (b) it has a controlled diameter and substantially round cross section, (c) it can form fairly uniform non-woven structures, and (d) it can be processed through familiar textile production steps in order to weave, knit, twist, and card. In some aspects, the tensile properties of the above materials may be increased if the PTFE polymer structure could be formed prior to the sintering process.

It is of interest in some applications to increasing the tensile strength of their yarns, improving their dimensional stability at elevated temperatures, and modifying the surface characteristics to improve wettability. In some cases, application of HIU causes the formation of PTFE structures within the intermediate fiber structure. These structures may enable processing of the polymer in different ways. For example, the polymer can be processed into an improved fiber without the use of heat to sinter PTFE particles. The result reduces production costs and also improves tensile strength. Also, an expanded structure retains the characteristics mentioned above. This expanded structure would advance the art of PTFE fiber manufacturing and expand its useful applications, and, consequently, its marketability.

Furthermore, the presently-described material transformations could be implemented in line, through the use of ultrasound transducers, which could produce the desirable changes without direct physical contact with the fiber, with modest cost, and with minimal disruption of the fiber production process.

An embodiment provides the capability of HIU to induce fibrillation in aqueous dispersions of PTFE nanospheres—being generally very small spherical or other particulates, having dimensions substantially smaller than a wavelength of the applied ultrasound in the liquid medium in which they exist. The PTFE nanospheres can be "fibrillated" by certain exposure to local shear stresses due to acoustic action thereon, causing them to form mechanical bonds with one another. The present methods and apparatus can in some embodiments induce nanosphere fibrillation in aqueous dispersions, and determine the acoustic parameter space for optimal fibrillation induction.

Another embodiment induces fibrillation by HIU in situ in PTFE homopolymer filaments. PTFE nanospheres may be fibrillated within the structure of a homopolymer filament, and the present methods and apparatus may determine the acoustic parameter space for optimal fibrillation induction within the filaments.

Still another embodiment modifies the surface characteristics of PTFE homopolymer filaments from hydrophobic to hydrophilic. An expansion in the applications and marketability of PTFE-based yarns may be achieved if the filaments/fibers were to be made hydrophilic. HIU may in some instances appropriately modify the filament surface so as to make it wettable as enabled by the present methods and systems.

FIG. 1 illustrates an exemplary setup to achieve the present transformations in fibers, particles, small spheres, and similar PTFE or other materials. A horn 110 is placed in relation to or within or proximal to a sample of polymeric substance suspended in or mixed in a fluid coupling medium. The acoustic driver (e.g., horn or other ultrasonic driver 110) is coupled to a driving circuit that applies an appropriate energy and frequency of driving signals thereto, as discussed above. The ultrasonic energy is carried to the PTFE sample through the liquid coupling medium. A suitable container or reaction chamber for causing such ultrasonic action, including in some embodiments, for causing cavitation proximal to the sample, is described in co-pending patent applications by the present assignee, e.g., those identified in attorney docket numbers IDI.USPAT.0300, entitled "Pressurized Cavitation Resonator with Fluid Flow-Through Feature," and each of the other patents issued and pending to the present applicants and assignee, all of which are hereby incorporated by reference. In addition, other cavitation and ultrasound and acoustic applicators and sonication chambers and reactor vessels are understood to be comprehended by the above discussion, not being limited to those designs explicitly discussed in the present preferred embodiments.

For the sake of illustration, FIG. 1 shows a simplified diagram of an acoustic resonator, reactor, or cavitation system 10 suited to cause a useful material transformation on a material containing elements of a polymeric substance. A vessel 100 contains a volume of fluid which is to be cavitated or to which an acoustic field of a suitable intensity level is to be applied. An acoustic driver such as a PZT transducer horn 110 is used to apply said acoustic field to the substances within vessel 100.

Horn or ultrasonic transducer source 110 is driven by an electrical driving signal generated by signal generator 120, which provides an output signal that is amplified by amplifier 130. The output of amplifier 130 is coupled to a conducting surface or electrode on transducer 110 to cause the transducer to vibrate, oscillate, or otherwise make an acoustic (e.g., ultrasonic) output. The acoustic output of transducer 110 is then transmitted to the contents of vessel 100.

Under certain conditions, the acoustic action of transducer horn 110 and vessel 100 set up an acoustic field within the fluid in vessel 100 that is of sufficient strength and configuration to cause acoustic cavitation within a region of vessel 100. Specifically, under suitable conditions, acoustic cavitation of the fluid in vessel 100 may cause bubbles 199 or acoustically-generated voids as described above and known to those skilled in the art, to form within one or more regions of vessel 100. The cavitation usually occurs at zones within the vessel 100 that are subjected to the most intense (highest amplitude) acoustic fields therein.

Fibrillation of nanospheres may be achieved using the present methods and apparatus so that useful wetting properties and other material properties of such small particles can be gained. In some embodiments, the tensile strength of fibers comprising such small spheres and particles is increased by the present sonication and resulting material and/or structural transformations.

In some embodiments, the PTFE fibrillation may result from (among other things) local shear stresses placed on the nanospheres and small structures. The magnitude of these stresses is not relatively high as rough handling may induce a low level of fibrillation. The introduction of such stress forces is an aspect of the present method and apparatus, which can be modified in various embodiments to suit a particular application.

The present concepts would also apply to other one-dimensional, two-dimensional, and three-dimensional particles and objects of interest, in various situations, and is not limited to the preferred sample shapes, sizes, or materials given herein for the sake of illustration.

In general, the present method and apparatus can in some embodiments expose an aqueous dispersion of nanospheres or other materials of interest to acoustic sources, at selectable or variable power levels and frequencies. The resulting transformations can be quantified and/or monitored by a monitoring system, e.g., using electron microscopy optionally with a particle counter to determine the incidence and degree of fibrillation and customize the result to the desired outcome.

Figure 2:
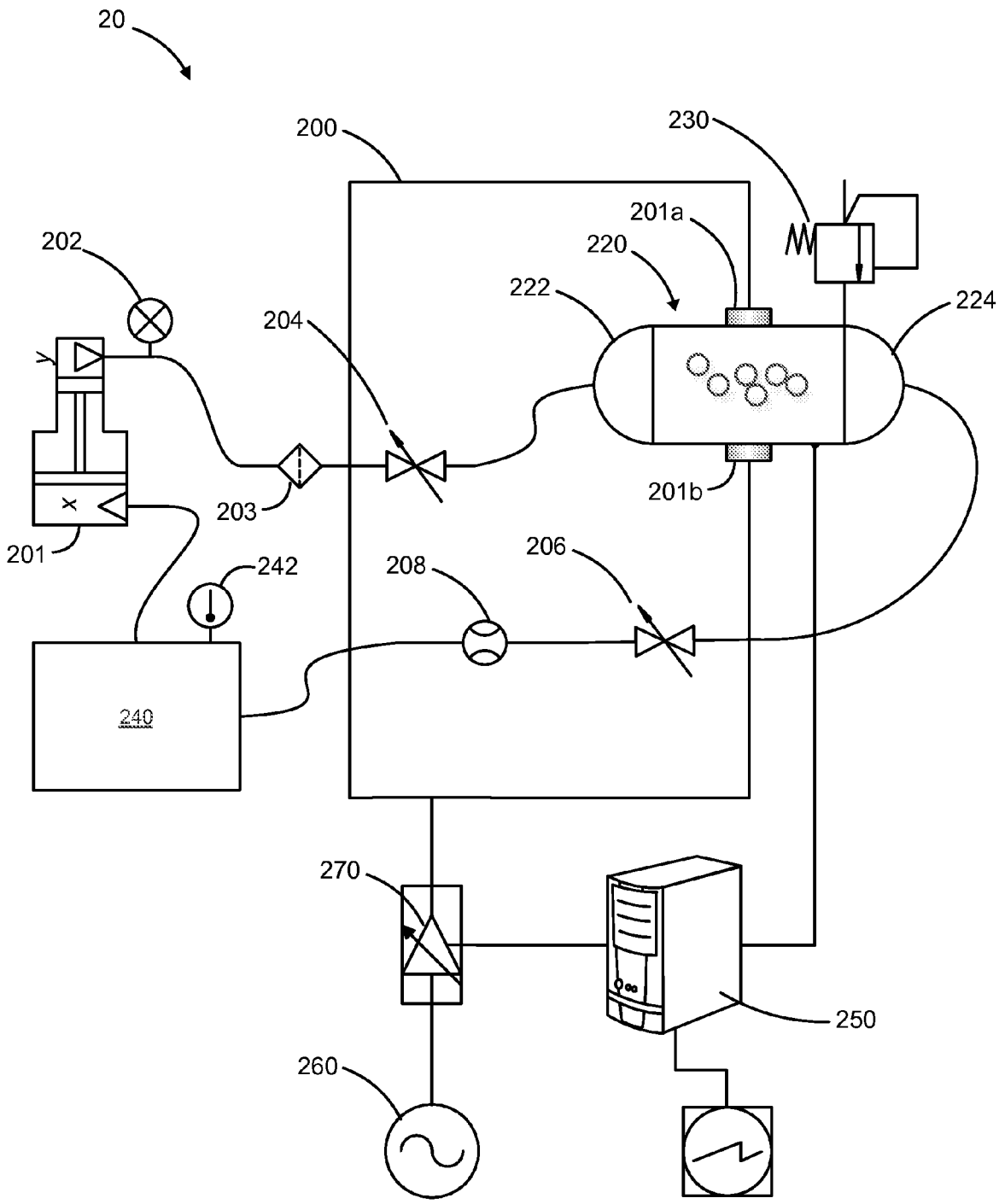
FIG. 2 illustrates an exemplary acoustical reactor vessel and fluid processing system for causing material transformation of a polymeric substance.

FIG. 2 illustrates an exemplary acoustic resonator and cavitation system 20. The system includes an electrical circuit 200 for driving the acoustic drivers 201*a* and 201*b* (which can be generalized to a plurality of acoustic drivers). The circuit is controlled by a controller or control processor or control computer 250. A signal generator or waveform generator 260 provides a signal that is amplified by amplifier 270, which is in turn computer-controlled by computer or processor 250. As mentioned earlier, the driving output of amplifier 270 provides the electrical stimulus to cause transduction within transducers 201*a, b*, which in turn cause acoustical field generation within resonator chamber 220.

The heavier lines of FIG. 2 represent a fluid circuit that circulates a fluid to be acoustically cavitated in resonator or chamber 220. The resonator 220 comprises a first end cap or end bell 222 at a first end thereof, and a second end cap or end bell 224 at a second end thereof. Said first and second ends of resonator 220 being substantially at opposite ends of said resonator 220 in some embodiments. Generally, a fluid is flowed in resonator 220, sometimes under static pressure, and said fluid may be cavitated by acoustic transducers 201*a, b*. As will be described further, the relative placement of the transducers and the fluid inlet and outlet ports in the system with respect to the acoustic field within the resonator 220 is arranged to achieve a desired outcome in processing the flowing pressurized fluid and/or materials suspended or dissolved therein.

The fluid circuit includes a fluid driver (e.g., a pump such as a rotary or reciprocating pump) 201. The pump 201 drives the fluid against the head loss in the fluid circuit portion of cavitation system 20. A pressure gauge 202 may be installed at a useful location downstream of pump 201 to monitor the pressure at its highest value downstream of pump 201. A filter 203 may be used inline with the flowing fluid to trap any impurities or dirt in the fluid.

A solenoid or gate valve 204 may be used to secure the fluid flow in some cases or to isolate the resonator upstream of the resonator 220. A second solenoid valve 206 is used to secure flow of the fluid or to isolate the resonator 220 in cooperation with valve 204.

Relief value 230 may be provided as a safety mechanism to relieve fluid from the system if the pressure of said fluid exceeds a pre-determined threshold. For example, the relief valve may be set to discharge fluid in a controlled way if the pressure within resonator 220 approaches a value that could jeopardize the integrity of the resonator or other system components.

Fluid flow rate meter 208 may be used to sense and provide an indication of the rate of fluid flow (e.g., in cubic centimeters per second) through the fluid system. Because the fluid is generally incompressible, the fluid flow rate in the outlet portion of the system (as pictured) is substantially the same as the flow rate at the inlet to resonator 220.

A fluid holding, storage, surge or expansion tank or reservoir 240 is provided to contain an adequate amount of fluid and mediate any volumetric or pressure surges in the system. A temperature sensor (thermometer) 242 is used to provide an indication of the temperature of the fluid in the system.

One exemplary acoustic energy source is that of a "low frequency" acoustic horn. This source generates acoustic fields of pressure amplitudes on the order of 1 MPa and with frequencies in the tens of kilohertz range in some embodiments. Such a source is discussed here as an example for illustrative purposes. These types of acoustic sources can generate CW signals at (e.g.) 40 kHz and with a pressure amplitude on the order of 1 MPa; and can generate shock waves with maximum positive pressures of about 30 MPa and effective frequencies of about 200 kHz (with a PRF of 1-3 Hz). In an embodiment, an ultrasonic therapeutic ultrasound source may be employed, which can generate continuous wave (CW) positive pressures of about 80 MPa at a frequency of 2 MHz.

In some embodiments, one mechanism for mechanical effects produced by HIU is cavitation, and the positive pressure (P+) and the negative pressure (P−) resulting would cause acoustic cavitation in some or all of the present systems. The cavitation voids or bubbles can act to cause or enhance local high-intensity fluid and acoustic effects, including shock wave generation, heating, mixing, streaming, and other resulting phenomena.

The acoustic sources need not be driven at maximum intensity and thus offer a wide range of acoustic parameters that enable the determination of the acoustic parameter space for nanosphere fibrillation induction. In order to evaluate the onset of nanosphere fibrillation in some embodiments, electron microscopy and particle counters such as Coulter counters may be used for this purpose. Also, other microscopy and quantification, visualization, data processing (computer) and signal processing apparatus may be coupled to the present system for control, measurement, and other functions. Furthermore, passive and active acoustic sensors may be used for such detection in the present systems.

In an embodiment, a sample, comprising approximately 5 cc of an aqueous dispersion of PTFE nanospheres, is encapsulated in a finger cot and exposed to an acoustic field from a vibrating ultrasonic horn. The finger cot is placed a few centimeters below the horn's tip and driven at a relatively low power amplitude, and insonified by the acoustic field for exposure times of 10 and 30 seconds. The exposures and parameters above are merely illustrative, and other values of these are possible. A control apparatus may be used in some embodiments to allow control of the acoustic output of the sources to achieve the desired outcomes, including a microprocessor-controlled control apparatus.

In yet other embodiments, a Coulter counter output provides a plot of the distribution of various particle sizes contained within the test sample. If fibrillation occurs, and particle aggregation results, the size distributions of the control and treated samples are different, and appropriate adjustments are made.

Various arrangements of the present apparatus and using embodiments of the present method, PTFE nanospheres may be fibrillated with relatively weak mechanical stresses if desired. This can allow the induction of nanosphere fibrillation discussed above.

In further embodiments, some level of fibrillation in the interior of a PTFE filament itself is accomplished using the present systems and methods. For example, in fibrillation achieved in an aqueous dispersion. In yet other embodiments, fibrillation is accomplished in a moving filament of fibers or other materials in an in-line production process. A motorized puller may pull a sample of fibers past an acoustic sonication zone at a determined rate so that a certain acoustic energy and dose is applied to the sample to create the desired transformative result. The choice of liquid coupling medium in this case can also be determined by the outcome desired, for example, by including some chemical substances in the coupling medium that are desired to be chemically or mechanically bonded to the passing fibers.

The present systems allow for controlling the parameter space used to cause the instant transformations, for example, by utilizing different acoustic sources and different exposure conditions. These techniques specifically apply HIU to PTFE homopolymer filaments in some embodiments, and determine the acoustic parameter space that will induce PTFE structures within the filament itself. Still more specifically, the present embodiments can cause the formation and modification of micro-structures within the structure of the filament itself. However, it should be appreciated that the parameter space so determined can be applied to various applications of the present techniques. Non-acoustic shear and acoustic induced shear stress can be combined in any combination useful for accomplishing a given objective in this regard. The HIU will induce microstructures within the filaments, which results in an increase in filament/fiber tensile strength.

Unique, new, and novel materials and material properties are provided hereby in some embodiments. As an exemplary tool for determining such material effects and results, electron X-ray dispersive analysis may be performed and/or coupled to the present systems and methods to determine the chemical composition of the microstructures. The results of an exemplary such determination show that a composition of the microstructures may not be typical of cellulose in some embodiments, and in other embodiments may be typical of PTFE. Particularly, by way of example, a resulting microstructure that includes about 83% Carbon; 4% Oxygen; and 13% Fluorine differs somewhat from that of conventional PTFE, viz., 86% Carbon; 0% Oxygen and 14% Fluorine. Also, oxygen may be induced to be present from the cellulose processing used in the spinning process.

In some embodiments, the treatment can include exposing the samples to shock waves, e.g., those available from commercial, special-purpose, or medical lithotripsy machines or similar shock-producing apparatus. In an embodiment, the specimen is subjected to 50 and 150 shock waves from a research lithotripter, but those skilled in the art can accommodate other exposures depending on the desired outcome. The shock waves may apply a very localized and extreme pressure variation to the sample, causing fibrillation, separation, and other useful material transformations.

In yet other embodiments, the present method and system are extended to accommodate inclusion of a filament tensile strength testing device to measure and/or control the present process so that improved tensile strength results.

For some applications, as mentioned earlier, it is useful to embed or include the sample in a fluid or solid matrix material. The acoustic and/or material and/or chemical and/or mechanical effects thereof would then be optimized in the given example to achieve the desired outcome, for example, to increase tensile strength or wetting characteristics of the sample. In situations where fibers, nanospheres or similar materials are processed, acoustic shock waves, either from collapsing cavitation bubbles or from a shockwave source, are made to penetrate within the filament structures to induce interior nanosphere fibrillation and increase sample tensile strength.

In addition, the present methods and systems can impart a surface modification to a continuous filament yarn. This surface modification could take on any number of characteristics, but for example can include the erosion of the surface (in some examples by at least 1% of its total diameter). In some embodiments, the treated fibers become wettable, and form stable aqueous dispersions. Further, these wettable fiber dispersions flow easily and can be pumped and moved using available technologies.

The wettability of the fibers is useful in some applications and can be accomplished without major modification of an existing in-line production process. For example, PTFE fibers may be used in some technical applications to achieve a desired chemical resistance and/or low coefficient of friction. In some embodiments, the present techniques allow adhering the PTFE fibers to a substrate or in a resin system. These transformations may enable formation of more stable resin systems and provide for greater adhesion with a substrate, thus improving self-lubricated bearing systems as an example.

Additionally, the present methods and systems can transform materials from hydrophobic to hydrophilic, e.g., by stripping a hydrophobic coating or surface effect from the sample, which can be useful in various industrial applications. This scrubbing is accomplished in some embodiments through the intense localized fluid flow and shock wave phenomena associated with ultrasound acoustic streaming and cavitation.

Figure 3:
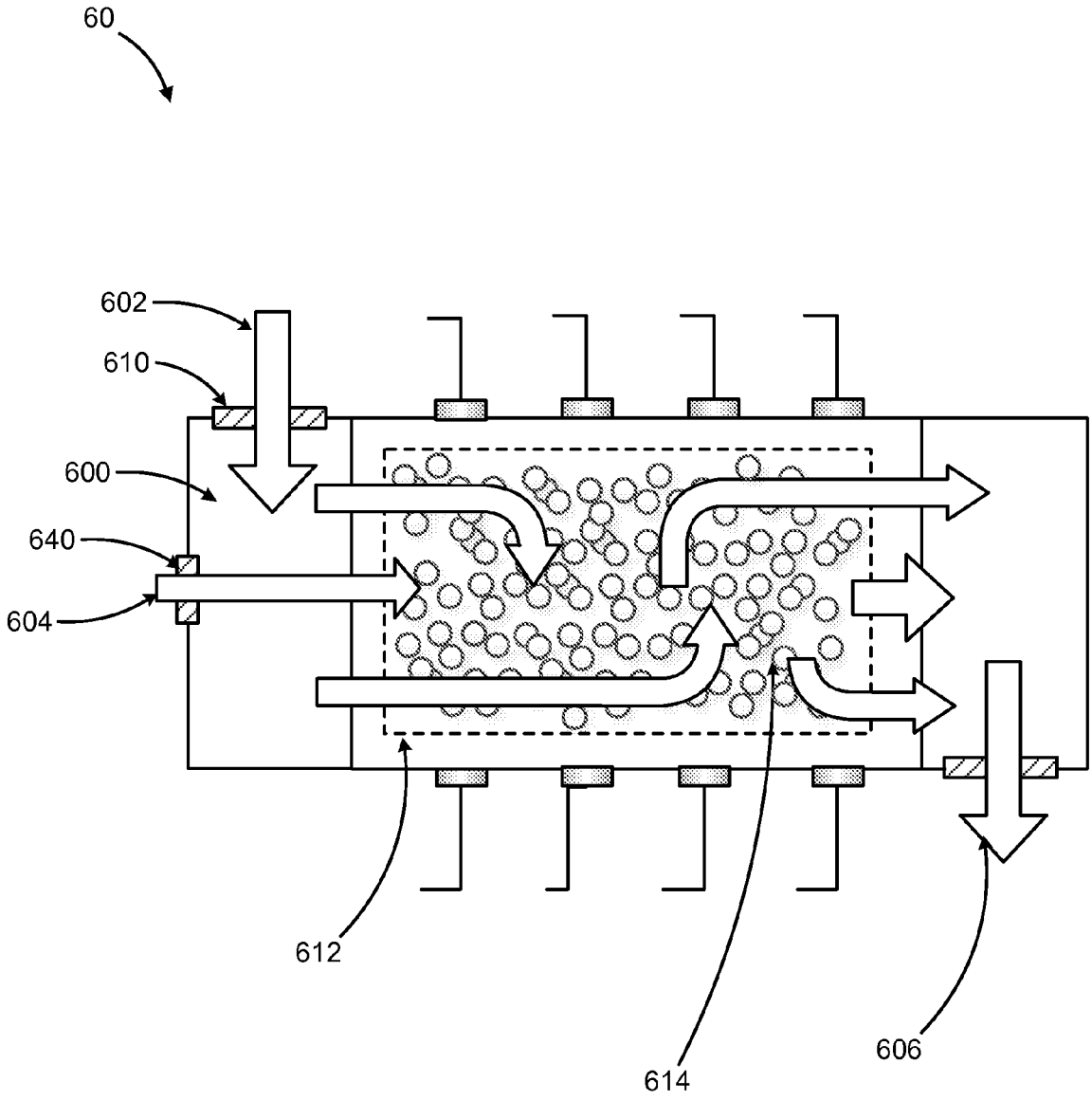
FIG. 3 illustrates an exemplary reactor vessel that additionally allows mixing two or more fluids or components (e.g. polymeric substance and a fluid medium, resin, or other chemical agent) therein, each entering through respective inlet ports.

FIG. 3 illustrates a reaction vessel 60 that allows sonication in a cavitation zone 612 to generate cavitation bubbles 614 and other cavitation related phenomena. A first fluid 602 is input through a first inlet port 610 to inlet volume 600. A second fluid 604 is input through a second inlet port 640 to inlet volume 600 as well. The first and second inlet ports 610, 640 are located at different positions in the body of inlet volume 600, for example, one being at the end of the inlet volume 600 and the other being in a side wall of inlet volume 600.

Once the first and second fluids have entered the vessel 60 they are allowed to mix with one another. The first and second fluids mix at a desired location in the vessel 60. For example, the first and second fluids may undergo mechanical mixing as well as enhanced mixing due to the cavitation in cavitation zone 612 of the chamber. The fluid 606 exits after mixing and cavitation have taken place. As mentioned above, the entire fluid flow, mixing, and cavitation processes may take place under a static or baseline pressure, e.g., a positive, greater than ambient pressure, and the static pressure can be provided by a pump or gas loading apparatus.

Figure 4:
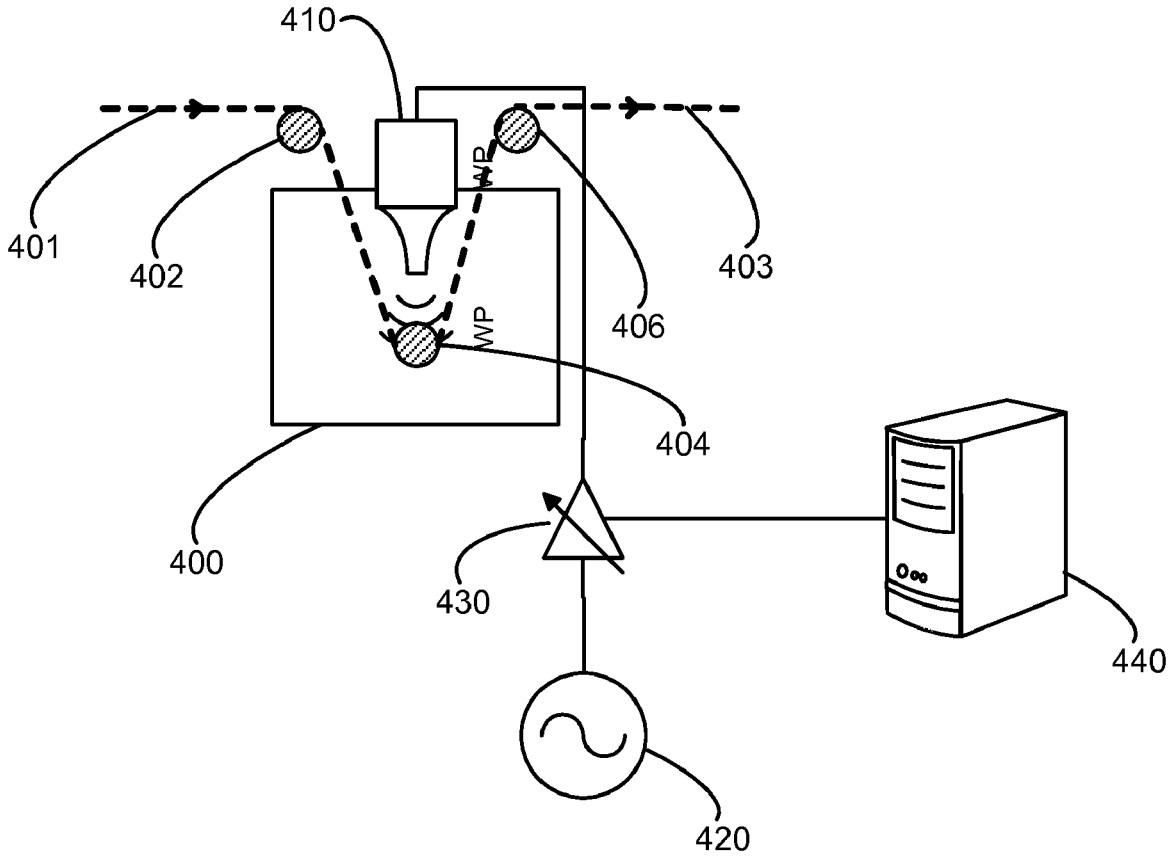
FIG. 4 illustrates an exemplary in-line processing system.

FIG. 4 illustrates an exemplary in-line processing system for processing a polymeric substance in elongated fibrous form. An acoustical source 410, e.g. a transducer or horn is driven by an amplifier 430 receiving a driving signal from a signal generator 420. The driving signal, monitoring, and control of the apparatus may be accomplished by a processor or computing device 440.

A vessel 400 holds an amount of fluid medium, which may be under static pressure, and may be flowing through the vessel through inlet and discharge ports. A suitable system of mechanical movers may be coupled to a motorized driver to move the elongated fibers of polymeric material past the sonication zone in vessel 400. The polymeric substance may have a first form or characteristic at 401 prior to being subjected to the material transformation of the acoustic source 410. After passing through the processing system, the processed polymeric substance at 403 may have a second, different, form or characteristic as a result of the processing. The processing may include heat or chemical processing as mentioned before, and may be performed in-line in a processing system. Here, several wheels or rollers 402, 404, 406 facilitate rolling the fibers past the horn 410 for sonication of the fibers.

The present invention should not be considered limited to the particular embodiments described above, but rather should be understood to cover all aspects of the invention as fairly set out in the attached claims. Various modifications, equivalent processes, as well as numerous structures to which the present invention may be applicable, will be readily apparent to those skilled in the art to which the present invention is directed upon review of the present disclosure. The claims are intended to cover such modifications.

What is claimed is:

1. A method for processing a polymeric substance, comprising:

placing a plurality of discrete elements of a polymeric substance and a fluid medium containing said polymeric substance into a vessel;

driving one or more acoustic sources coupled to said vessel with an electrical driving signal so as to cause transduction by said sources to establish an acoustic field within said vessel;

applying said acoustic field to a combination of said polymeric substance and said fluid medium;

causing at least a portion of said combination of polymeric substance and fluid medium to undergo an acoustic effect, due to said applied acoustic field, sufficiently to cause a material transformation of a plurality of said discrete elements of said polymeric substance from a first form prior to application of said acoustic field to a second form following application of said acoustic field.

2. The method of claim 1, further comprising mixing said polymeric substance and said fluid medium to form a suspension of said discrete elements of said polymeric substance within said fluid medium.

3. The method of claim 1, further comprising cavitating at least said fluid medium using said acoustic field.

4. The method of claim 1, further comprising pressurizing contents of said vessel to a pressure greater than an ambient pressure during application of said acoustic field.

5. The method of claim 1, said first form of said polymeric substance comprising substantially discrete elements of said polymeric substance and said second form comprising a form where said discrete elements have been substantially coupled to one another through the action of said acoustic field.

6. The method of claim 5, said first form comprising fibrous elements and said second form comprising substantially linked groups of said fibrous elements.

7. The method of claim 5, said first form comprising substantially discrete nanospherical elements, and said second form comprising substantially fibrillated clusters of said nanospherical elements.

8. The method of claim 1, further comprising coating said polymeric substance with a resin material from said fluid medium.

9. The method of claim 1, placing said fluid medium comprising placing a fluid medium of suitable acoustic coupling characteristics into said vessel.

10. The method of claim 1, further comprising forcing said fluid medium and said polymeric substance to flow from an inlet of said vessel, through an interior volume of said vessel, and out a discharge port of said vessel.

11. The method of claim 1, further comprising applying a shear stress to said polymeric substance by using said acoustic field so as to alter a coefficient of friction of said polymeric substance.

12. The method of claim 1, said driving step comprising acts of varying a power level of said electrical driving signal according to a level of material transformation of said polymeric material that has taken place.

13. The method of claim 1, processing said polymeric substance comprising processing a PTFE substance.

14. The method of claim 1, further comprising fibrillating said polymeric substance in the material alteration of the same.

15. The method of claim 1, said first form comprising elongated fiber bundles and said second form comprising separated fibers.

16. The method of claim 1, said first form comprising a fibrous form having a first wetting characteristic, and said second form comprising a fibrous form having a second wetting characteristic, said second wetting characteristic being greater than said first wetting characteristic.

17. The method of claim 1, said driving step comprising driving an ultrasonic horn source so as to generate ultrasound energy from said horn, and said applying of said acoustic field comprising applying said horn proximal to a sample of said polymeric substance so as to achieve said material transformation of said polymeric substance.

18. The method of claim 1, said first form comprising a hydrophobic form and said second form comprising a hydrophilic form and said material transformation comprising stripping said hydrophobic form of a hydrophobic component thereof.

19. The method of claim 1, said first form comprising a form having a first load capacity and said second form having a second load capacity, said second load capacity being greater than said first load capacity.

20. The method of claim 1, further comprising employing said polymeric substance in said second form in a manufacturing step for manufacturing an article of manufacture therewith.

21. The method of claim 20, said manufacturing step comprising manufacturing of a mechanical bearing component.

22. The method of claim 1, further comprising eliminating a cellulosic component of said polymeric substance from application of said acoustic field.

23. The method of claim 1, further comprising fusing together a plurality of said discrete elements of said polymeric substance.

24. The method of claim 1, further comprising heating said polymeric substance so as to affect the material properties thereof.

25. The method of claim 1, further comprising adding a chemical agent to a suspension of said polymeric substance and said fluid medium so as to affect the chemical properties thereof.

26. The method of claim 1, further being part of an in-line process of other processing steps for processing a substance comprising at least said polymeric substance.

27. The method of claim 1, further comprising applying an acoustic shock wave to a portion of a volume within said vessel so as to cause a material transformation of said polymeric substance.

28. The method of claim 1, further comprising monitoring an effect of said material transformation and adjusting said processing based on a result of said monitoring.

29. The method of claim 28, further comprising monitoring said transformation using a microscope.

30. The method of claim 28, further comprising monitoring said transformation using a particle counter.

31. The method of claim 28, further comprising monitoring said transformation using a Coulter counter.

32. The method of claim 1, further comprising controlling a duration of said application of said acoustic field to a sample of said polymeric substance.

* * * * *